United States Patent [19]

Zafred et al.

[11] Patent Number: 5,061,176

[45] Date of Patent: Oct. 29, 1991

[54] APPARATUS AND PROCESS FOR SIMULTANEOUSLY POSITIONING AND OSCILLATING A PLURALITY OF PROBES IN THE HEAT EXCHANGER TUBES OF A NUCLEAR STEAM GENERATOR

[75] Inventors: Paolo R. Zafred, Murrysville; David A. Snyder, N. Huntingdon; John B. Gunter, Munhall; William C. Ritz, Greensburg, all of Pa.

[73] Assignee: Westinghouse Electric Corp., Pittsburgh, Pa.

[21] Appl. No.: 599,770

[22] Filed: Oct. 18, 1990

Related U.S. Application Data

[62] Division of Ser. No. 213,923, Jun. 30, 1988, Pat. No. 5,000,681.

[51] Int. Cl.[5] ..... F24J 3/00; F27D 3/00

[52] U.S. Cl. ..... 432/5; 432/224; 432/225; 432/175; 432/10; 432/45; 122/379

[58] Field of Search ..... 432/224, 225, 5, 175, 432/10, 45; 122/379

[56] References Cited

U.S. PATENT DOCUMENTS

| | | | |
|---|---|---|---|
| 3,761,550 | 9/1973 | Seefluth | 432/224 |
| 4,018,344 | 4/1977 | Leshem | 214/1 BB |
| 4,231,419 | 11/1980 | Gugel | 165/11 A |
| 4,283,615 | 8/1981 | Vrillon | 219/66 |
| 4,425,296 | 1/1984 | Adamowski et al. | 376/245 |
| 4,453,501 | 6/1984 | Hayes et al. | 165/11 R |
| 4,494,907 | 1/1985 | Coussau et al. | 414/749 |
| 4,507,082 | 3/1985 | Wandlan, III | 432/225 |
| 4,567,012 | 1/1986 | Radcliff | 376/245 |
| 4,597,294 | 7/1986 | Brill, III et al. | 73/623 |
| 4,633,177 | 12/1986 | David et al. | 324/220 |
| 4,639,994 | 2/1987 | Cooper, Jr. et al. | 376/260 |
| 4,643,029 | 2/1987 | Klinvex | 376/249 |
| 4,649,989 | 3/1987 | Vermaat et al. | 165/11.2 |
| 4,654,943 | 4/1987 | Rabe | 29/157.4 |
| 4,694,677 | 9/1987 | Rabe | 72/393 |

*Primary Examiner*—Henry C. Yuen

[57] ABSTRACT

An apparatus and process for positioning and for simultaneously oscillating a plurality of heater probes within a plurality of heat exchanger tubes mounted in a tubesheet of a nuclear steam generator is disclosed herein. The apparatus generally comprises a frame, a plurality of probe drivers mounted onto the frame, wherein each driver includes a pneumatically operated, bladder-type gripper for selectively gripping and ungripping the push-cable of one of the heater probes, as well as an oscillating mechanism powered by a variable voltage d.c. motor. A controller connected between the d.c. motor and a power source separately controls the frequency and the amplitude of the cycle that the oscillating mechanism moves the gripper in, and further controls the alignment between the midpoint of the oscillatory cycle and a selected point along the longitudinal axis of the tube. The apparatus is movable to a selected position on the tubesheet by means of a robotic arm, and includes a coupling for remotely attaching and detaching the arm from the frame of the apparatus. The frame of the apparatus includes a pair of opposing cam-locks for detachably securing the apparatus at a selected position on the tubesheet, thereby advantageously freeing the robotic arm that delivered the apparatus. Finally, the frame is contoured to the shape of the inner walls of the steam generator so that the apparatus can service heat exchanger tubes located on the periphery of the tubesheet.

3 Claims, 5 Drawing Sheets

APPARATUS AND PROCESS FOR SIMULTANEOUSLY POSITIONING AND OSCILLATING A PLURALITY OF PROBES IN THE HEAT EXCHANGER TUBES OF A NUCLEAR STEAM GENERATOR

This is a division of application Ser. No. 07/213,923 filed June 30, 1988, U.S. Pat. No. 5,000,681.

BACKGROUND OF THE INVENTION

This invention generally relates to an apparatus and process for simultaneously manipulating probes within conduits, and is specifically concerned with a device for simultaneously oscillating a plurality of heater probes within a plurality of heat exchanger tubes mounted in the tubesheet of a nuclear steam generator in order to thermally stress relieve these tubes.

New processes for thermally relieving the tensile stresses which may occur in the support plate regions of the heat exchanger tubes of a nuclear steam generator have recently created a need for a device that is capable of moving such heater probes along an oscillatory path within such tubes. Specifically, in the heat-treating process disclosed and claimed in copending U.S. patent application Ser. No. 069,721 filed June 6, 1987, by Wenche Cheng and assigned to the Westinghouse Electric Corporation, a heater probe in the form of a 1,000 watt tungsten halogen quartz lamp is inserted into the open end of a tube and oscillated in a portion of a heat exchanger tube which is circumscribed by a support plate in order to relieve the tensile stresses which are created in the annular space between the plate and the tube by the accumulation of sludge therebetween. The principal purpose of this process is to uniformly heat the walls of a heat exchanger tube in the support plate region to a temperature of between 1350 to 1450 degrees F. for a time period of approximately 4 to 6 minutes. As is specifically pointed out in the specification of this copending patent application (which is incorporated by reference into the instant specification), the heat sink properties of the support plate that surrounds the heat exchanger tube create a formidable obstacle to the attainment of a uniform heat gradient in this particular region of the heat exchanger tube. Experimental attempts Lo attain such a uniform temperature gradient through the use of a statically held heater probe had failed, with the center portion of the tube section (which contacts the plate) being underheated, and the end portions of the tube section being overheated. However, the inventor of copending U.S. patent application Ser. No. 069,721 overcame this problem by a process wherein the heat probe used to heat the section of the tube is oscillated such that the dwell time at the midpoint of the oscillation cycle (closest to the support plate) is twice as great as the dwell time at the end points of the oscillation cycle.

Initially, the aforementioned process was implemented by the manual manipulation of a push-cable connected to the heater probe. Later, a device was developed by the Westinghouse Electric Company that was capable of manipulating a single probe in a single tube. This device generally comprised a frame with a bladder-type gripper capable of gripping the push-cable connected to a probe. The gripper was in turn threadedly engaged to a leadscrew which was turned by a reversible D.C. motor. The frame further included a "pop-up" cylinder capable of temporarily raising the heater probe up a few inches so that an optical fiber connected to the probe could conduct the incandescent glow of the heated tube section back to a two-color pyrometer in order to obtain a temperature reading of the tube. The entire device was coupled to a robotic arm. While such a device has been shown to effectively implement the new heat treating process disclosed in copending patent application Ser. No. 069,721, the Applicant has observed several shortcomings associated with such a device, the most serious being its ability to heat-treat only one tube at a time. Since it may be necessary to heat-treat hundreds of heat exchanger tubes to complete the servicing of a single generator, the time required to complete the servicing could be lengthy. Such a lengthy servicing time could result in an increased downtime for the generator, which costs over $100,000.00 per day in lost revenues, and could also increase the amount of exposure of the maintenance personnel to potentially harmful radiation. Still other shortcomings of this single-tube device stem from its size and bulk, which requires the use of a robotic arm to support it in place after the device is positioned adjacent to the tube to be serviced, thus tying up the use of such an arm during the entire procedure. This is a significant drawback as there is only room for one such arm in the channel head of the generator to perform all the needed maintenance procedures.

Clearly, there is a need for a device that is capable of accurately positioning and simultaneously oscillating a plurality of such heater probes within the heat exchanger tubes of a steam generator in order to expedite the maintenance procedure. It would be desirable if such a device were capable of supporting itself once it was delivered to a desired position within the tubesheet of the steam generator so that the robotic arm used to deliver the device could be used for other purposes while the heat treatment of the tubes was being carried out. Finally, such a device should be compact and lightweight enough to be accurately held and delivered by a relatively inexpensive robotic arm, and capable of servicing both the peripherally and the centrally located tubes in the tubesheet without mechanical interference with any part of the channel head of the steam generator.

SUMMARY OF THE INVENTION

Broadly speaking, the invention is an apparatus for accurately positioning and for simultaneously oscillating a plurality of elongated devices, such as heater probes connected to push-cables, within a plurality of conduits which may be the heat exchanger tubes which are mounted on the tubesheet of a nuclear steam generator. The apparatus comprises a frame, a plurality of probe drivers mounted onto the frame for oscillating the heater probes within the tubes, each driver including a pneumatically operated gripper for selectively gripping and ungripping the push-rod of one of the heater probes, as well as an oscillating mechanism for oscillating the grippers at a selected frequency, and a control means connected to the oscillating mechanism of each of the drivers for independently controlling the positioning and frequency of each of the oscillation cycles.

The frame preferably includes a top plate, and the apparatus may further comprise means for detachably mounting the top plate to the frame onto the tubesheet of the steam generator in order to render the entire apparatus self-supporting. In the preferred embodiment, the detachable mounting means is a pair of cam-locks disposed on opposite ends of the top plate, Each of the cam-locks includes a locking member which is insertable within and expandable against the open end of one of the tubes in the tubesheet. The apparatus is deliverable to a selected portion of the tubesheet, and to this end, includes a coupler for releasably receiving a robotic arm. The provision of a detachable mounting means in the form of a pair of opposing cam-locks mounted on the top plate of the frame advantageously allows the delivering robotic arm to be freed up for other purposes once the apparatus has been delivered and secured to a selected portion of the tubesheet. Additionally, the profile of the frame is configured such that it can position and oscillate heater probes in the heat exchanger tubes that are located peripherally as well as centrally in the tubesheet. Finally the apparatus is lightweight enough to be deliverable by means of a relatively low-cost robotic arm.

The top plate of the frame may further include a plurality of bushings having openings which are arranged in the same pitch as the open ends of the tubes mounted in the tubesheet, so that the bushing openings may all be simultaneously aligned with the open ends of separate heat exchanger tubes. The grippers of each of the probe drivers are aligned with the openings of one of these bushings so that the grippers may serve to smoothly insert and manipulate a probe into the open end of the tube. Guide tubes may be provided for guiding the probes into the grippers. One end of each of the guide tubes may be connected to one of the grippers of the probe drivers, while the other end may be slidably received within an opening in a bottom plate of the frame. In addition to guiding probes into the grippers, these guide tubes help to maintain the grippers of the probe drivers in proper alignment with the tubes during the operation of the oscillating mechanism.

Each of the oscillating mechanisms of the probe drivers may include an electric motor connected to a source of electric power, and the control means is connected between the electric motor and power source. In the preferred embodiment, the electric motor is a d.c. motor, and the control means controls both the polarity and voltage of the electric power conducted to the motor from the power source in order the control both the frequency and the amplitude of the oscillatory motion generated by each probe driver. Each oscillating mechanism may also include a threaded shaft rotatably mounted in both the upper and the lower plates of the frame. The output of the electric motor is mechanically connected to the threaded shaft by means of a gear train. A ball nut threadedly engages the gripper of each of the probe drivers to the threaded shaft, so that the gripper moves when the shaft rotates. In addition to providing an oscillatory movement to the ball nut and hence to the heater probe held by the gripper, the oscillatory mechanism may also be used to make fine adjustments in the positioning of the heater probe with respect to the section of tubing to be heat treated. This is important, since the midpoint of the oscillatory cycle should be aligned with the midline of the support plate if the heat treating process is to be properly executed. The independent control of each of the motors of each oscillating mechanism advantageously allows all of the heater probes to be properly fine-positioned before the start of the heat-treating process despite variations in the initial positioning of the probes in the support plate regions.

In the preferred process of the invention, the system operators first determine how much power should be conducted through the heater probes in order to raise the temperature of the tubes in a particular support plate region to within the desired temperature range. This may be accomplished by means of the single tube device discussed supra, which features a hydraulic "pop-up" mechanism that momentarily exposes the optical fiber attached to the base of the heater probe to the light of incandescence of the sample tube being heated, which in turn conducts this light to a pyrometer. Once the power parameters associated with the desired tube temperatures are determined, a robotic arm delivers the apparatus to a selected position on the tubesheet, which has previously been loaded with heater probes that are connected to push-cables. Once positioned, the cam-locks detachably connect the device to the tubesheet, thus freeing the robotic arm up for other use. A reel-like device located outside the channel head then pushes the push-cables of each of the heater probes up through the heater exchanger tubes to be serviced until the probes are adjacent to the support plate region of the tubes. Such positioning is accomplished through the use of eddy current probes mounted to the base of each heater probe.

Once a particular heater probe is positioned, the gripper corresponding to the probe is activated so that it comes into gripping contact with the push-cable connected to the probe. The oscillating mechanism of each probe driver is then actuated in order to precisely align the midpoint of the heat zone emanated by the heater probe with the midline of the support plate, which in turn determines the midpoint of the amplitude of the oscillatory cycle. The heater probes are then actuated, as are each of the drivers so that each probe is oscillated above and below the midline of the support plate until the heat treatment is completed. In the preferred process, two or more multiple-probe oscillating apparatuses are used to expedite the heat treatment operation. Since each apparatus requires only a brief use of the robotic arm for delivery purposes, only one arm is necessary to keep two or more apparatuses in operation.

BRIEF DESCRIPTION OF THE SEVERAL FIGURES

DETAILED DESCRIPTION OF THE PREFERRED EMBODIMENT

General Overview Of The Structure And Operation Of The Invention

Figure 1B:
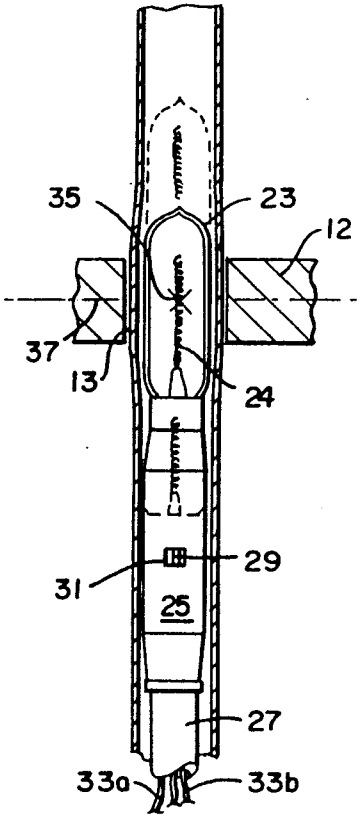
FIG. 1B is an enlargement of the area circled in FIG. 1A illustrating the type of heater probe that the apparatus of the invention is particularly adapted to oscillate within a heat exchanger tube.
Figure 1A:
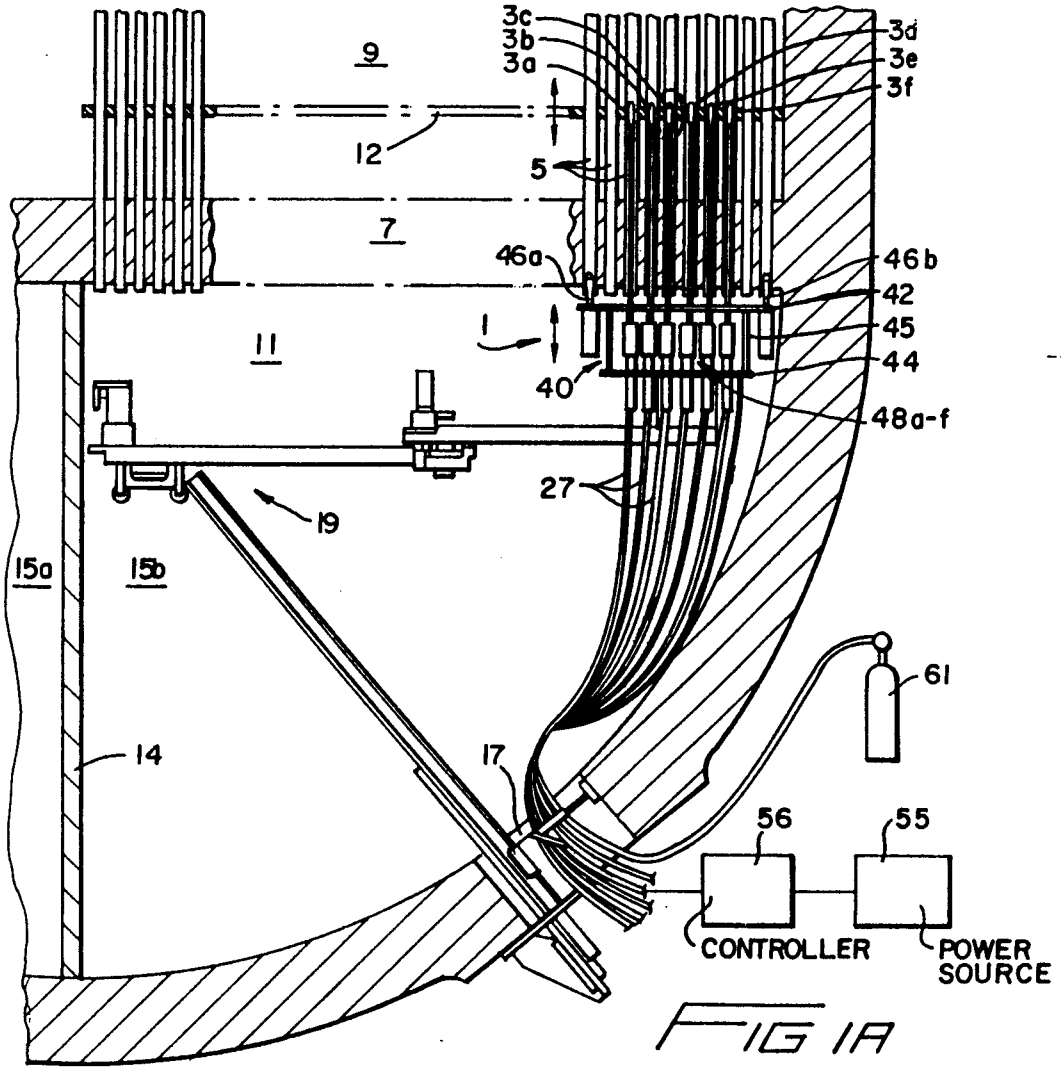
FIG. 1A is side view of the multiple probe oscillating apparatus 1 of the invention as it might appear in operation within the channel head of a nuclear steam generator.

With reference now to FIGS. 1A and 1B, wherein like components are designated by like reference numerals throughout all of the several figures, the principal purpose of the multiple probe oscillating apparatus 1 of the invention is to position and oscillate a plurality of heater probes 3*a*–3*f* within a plurality of heat exchanger tubes 5 that are mounted in the tubesheet 7 of a nuclear steam generator. The tubesheet 7 hydraulically isolates a secondary side 9 of the generator (which contains nonradioactive water) from the bowl-shaped primary side 11 of the generator (which contains hot, radioactive water that has flowed through the nuclear core of the plant). These heat exchanger tubes are supported in the secondary side 9 of the steam generator by a plurality of support plates 12, only one of which is shown. The heat exchanger tubes 5 extend through bores 13 present in the support plates 12. The bowl-shaped primary side 11 is hydraulically bisected by means of a divider plate 14 which defines a pair of mutually adjacent channel heads 15*a*,15*b*. Each of these channel heads 15*a*,15*b* includes a man way 17 which allows a robotic arm 19 to be installed with the channel head 15*b* as shown. The robotic arm 19 may be either a modified form of the Model SM-10 arm manufactured and sold by Zetec, Inc., located in Isaquah, Wash., or it may be the ROSA Model robotic arm manufactured and sold by the Westinghouse Electric Corporation located in Pittsburgh, Pa.

With reference now to FIG. 1B, the heater probes 3*a*–3*f* which the apparatus 1 of the invention is particularly adapted to oscillate each include a 1000 watt incandescent bulb 23 having an elongated, spiral-type tungsten filament 24 as shown. The bulb 23 screws into a base 25 which is preferably formed of a heat resistant ceramic material. Connected to the bottom of the base 25 is a flexible push-cable 27. An optical fiber 29 is mounted within the base 25 of the probe as shown. The upper end of the optical fiber 29 is disposed within an opening 31 in the base 25 which allows light from the glowing walls of a tube 5 being heat treated to strike the fiber 29. The fiber 29 extends all the way through the push-cable 27 and is optically connected to a two-color pyrometer (not shown). Such pyrometers are commercially available, and are capable of accurately determining the temperature of a given object on the basis of the color of the light that it emanates. Also included in the push-cable 27 are power wires 33*a*,33*b* for providing an electrical current to the elongated filament 24 of the incandescent bulb 23. As will become more evident hereinafter, the principal purposes of the apparatus 1 are to precisely position the midpoint 35 of the filament 24 of bulb 23 with the midline 37 of the support plate 12 which surrounds a selected heat exchanger tube 5, and then to oscillate the bulb 23 of each of the heater probes 3*a*–3*f* at a selected amplitude and frequency, the precise values of which are specifically described and claimed in copending U.S patent application Ser. No. 069,721 filed June 6, 1987, and assigned to the Westinghouse Electric Corporation.

With reference now to FIGS. 2A–2D, the apparatus 1 of the invention generally comprises a frame 40 formed from a top plate 42 and a bottom plate 44 which are interconnected by means of a side plate 45. A pair of cam-locks 46*a*,46*b* are provided on opposite sides of the top plate 42 for detachably connecting the frame 40 to the underside of the tubesheet 7 as is shown in FIG. 1A. A robotic arm coupler 47 extends out of the back end of the top plate 42 of the frame 40 for remotely coupling and decoupling the entire frame 40 to a robotic arm 19.

A plurality of probe drivers 48*a*–48*f* are mounted within the frame 40 of the apparatus 1. Each of these probe drivers 48*a*–48*f* includes an oscillating mechanism 50 for moving one of a plurality of probe grippers 51*a*–51*f* along an oscillatory cycle of a selected amplitude and frequency. Each of the oscillating mechanisms 50 is powered by a reversible d.c. motor 54 connected to a source of electric power 55 through a power controller 56. The controller 56 is capable of controlling both the speed and the direction of rotation of the output shaft of the reversible d.c. motor 54 by controlling the polarity and voltage of the electrical current conducted to the motor 54. In the preferred embodiment. Controller 56 is a Model No. 6220 programmable controller manufactured by Gould, Inc., located in Andover, Mass. As is best seen in FIG. 2B, each of the grippers 51*a*–51*f* includes a resilient, sleeve-like bladder 60 which contracts into a gripping position when it communicates with pressurized gas 61 through manifold 62 and coiled air tube 64.

In the process of the invention, the amount of electrical power that must be conducted through the power wires 33*a*,33*b* of the heater probes 3*a*–3*f* to heat the tubes 5 to the desired temperature is first ascertained by using a single probe oscillating tool (such as that described supra) to heat treat one of the support-plate regions of a heat exchanger tube 5 by passing a known amount of electrical power through the heater probe, and monitoring the resulting temperature of the tube 5 by utilizing the previously discussed "pop-up" feature of this tool to align the optical fiber window 31 of the probe with the heated portion of the tube 5. After a sufficient amount of sampling has been performed to precisely ascertain the amount of electrical power associated with the desired temperature, the single-probe tool is removed from the channel head 15*b*. While outside the channel head 15*b*, the multiple probe oscillating apparatus 1 is loaded with heater probes by inserting the probes 3*a*–3*f* within the grippers 51*a*–51*f* which are then actuated to grippingly engage the probes 3*a*–3*f*. The apparatus 1 is then inserted through the man way 17 of the channel head 15*b* and coupled on to the robotic art 19 by means of coupler 47. The robotic arm 19 then remotely positions the apparatus to a selected location on the underside of the tubesheet 7, and raises the entire apparatus 1 up high enough for the collets of the cam-locks 46*a*,46*b* to be inserted into and engaged within the open ends of two of the heat exchanger tubes 5, thereby securely mounting the entire apparatus 1 onto the tubesheet 7. The coupler 47 then remotely decouples the robotic arm 19 from the apparatus 1, thereby freeing the robotic arm 19 to perform other maintenance tasks, or to even install another multiple probe oscillating apparatus 1 onto the tubesheet 7.

Once the apparatus 1 is installed within the tubesheet, the grippers 51*a*–51*f* are relaxed into an ungripping position and the push-cables 27 of each of the heater probes 3*a*–3*f* are unwound from a reel (not shown) in such a manner so as to push the incandescent bulb 23 of each of these probes in the general vicinity of the section of the tube 5 that is surrounded by a support plate 12. Such positioning may be accomplished through the use of an eddy current probe (note shown) that is mounted onto the base 25 of the heater probes 3a–3f and by the application of the process described and claimed in copending U.S. patent application Ser. No. 615,868 filed May 31, 1984, by John M. Driggers et al, entitled "Process For Accurately Determining Plate Positions In Steam Generators" and assigned to the Westinghouse Electric Corporation, the entire specification of which is expressly incorporated herein by reference.

Once each of probes 3a–3f is generally positioned in the support plate region of its respective heat exchanger tube 5, the grippers 51a–51f are again actuated so that they securely grip the push-cable 27 of each of the probes 3a–3f. The oscillating mechanism 50 of each of the probe drivers 48a–48f then precisely aligns the midpoint 35 of the bulb filament 27 with the midline 37 of the support plate 12 by carefully controlling the amount and polarity of voltage that the power source 55 applies to the reversible d.c. motor 54 which powers each oscillating mechanism 50, and by monitoring the output of the eddy current probe that is preferably mounted onto the base of each heater probe 3a–3f. It should be noted that this "fine tuning" of the alignment between the midpoint 35 of the bulb filament 24 and the midline 37 of the support plate 12 is performed on a probe-by-probe basis. The applicants have observed that such a separate and individual fine-tuning of alignment is necessary due to the fact that the alignment between each probe 3a–3f and the midline 37 of the support plate 12 is slightly different after the generalized positioning of the probes (accomplished by the pushing of the push-cables 27) has been accomplished. Such separate and individual positioning is, of course, made possible by the independent control that the controller 56 exercises over the motor 54 of each oscillating mechanism 50.

After each of the probes 3a–3f is in proper alignment, the controller 56 then causes each of the oscillating mechanisms 50 to oscillate its respective gripper 51a–51f along a oscillatory cycle of a predetermined frequency and amplitude by controlling the polarity and the voltage of the current entering the d.c. motor 54 of each of the mechanisms 50.

Specific Description Of The Structure And Operation Of The Invention

Figure 2A:
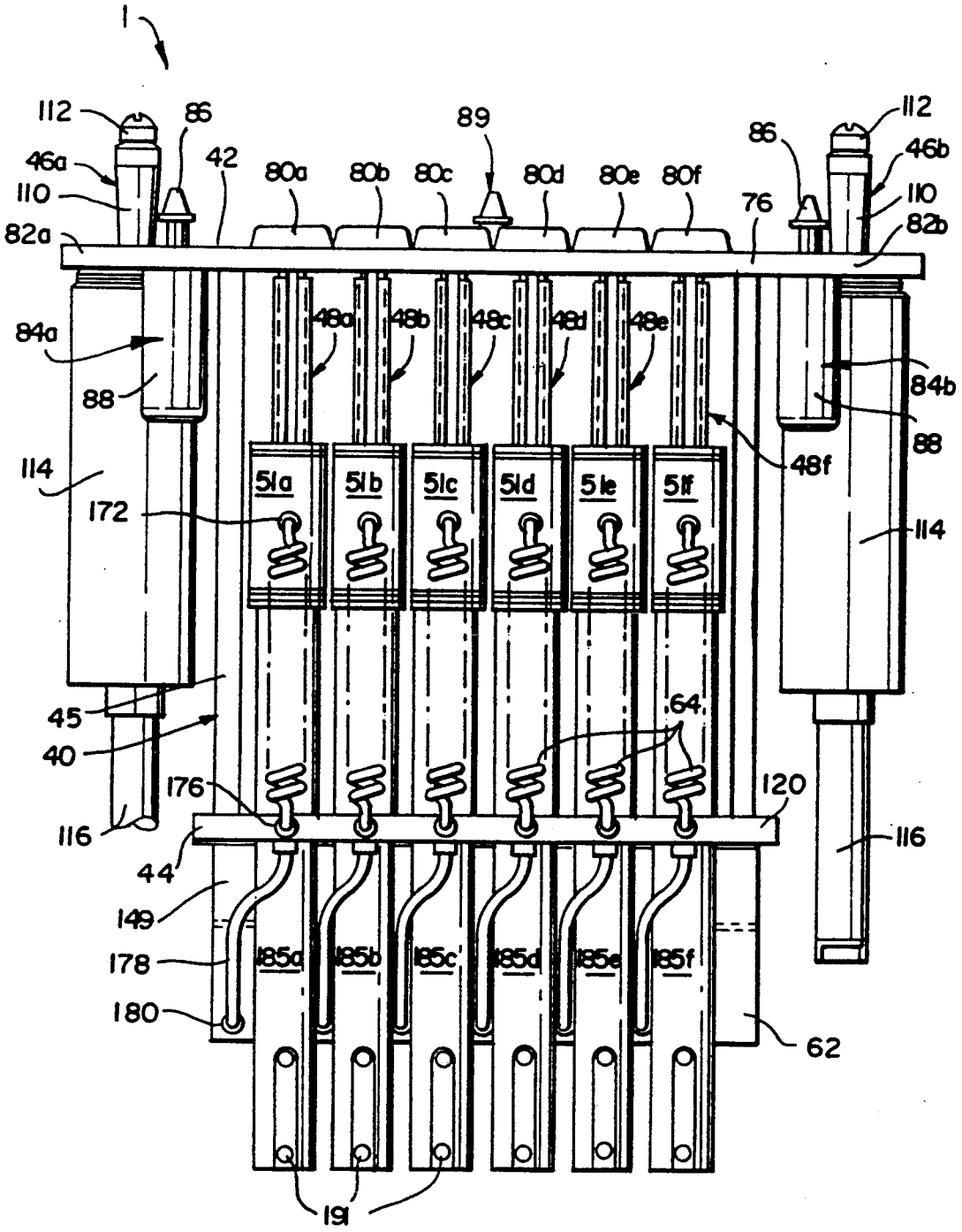
FIG. 2A is a front view of the multiple probe oscillating apparatus illustrated in FIG. 1A.
Figure 2B:
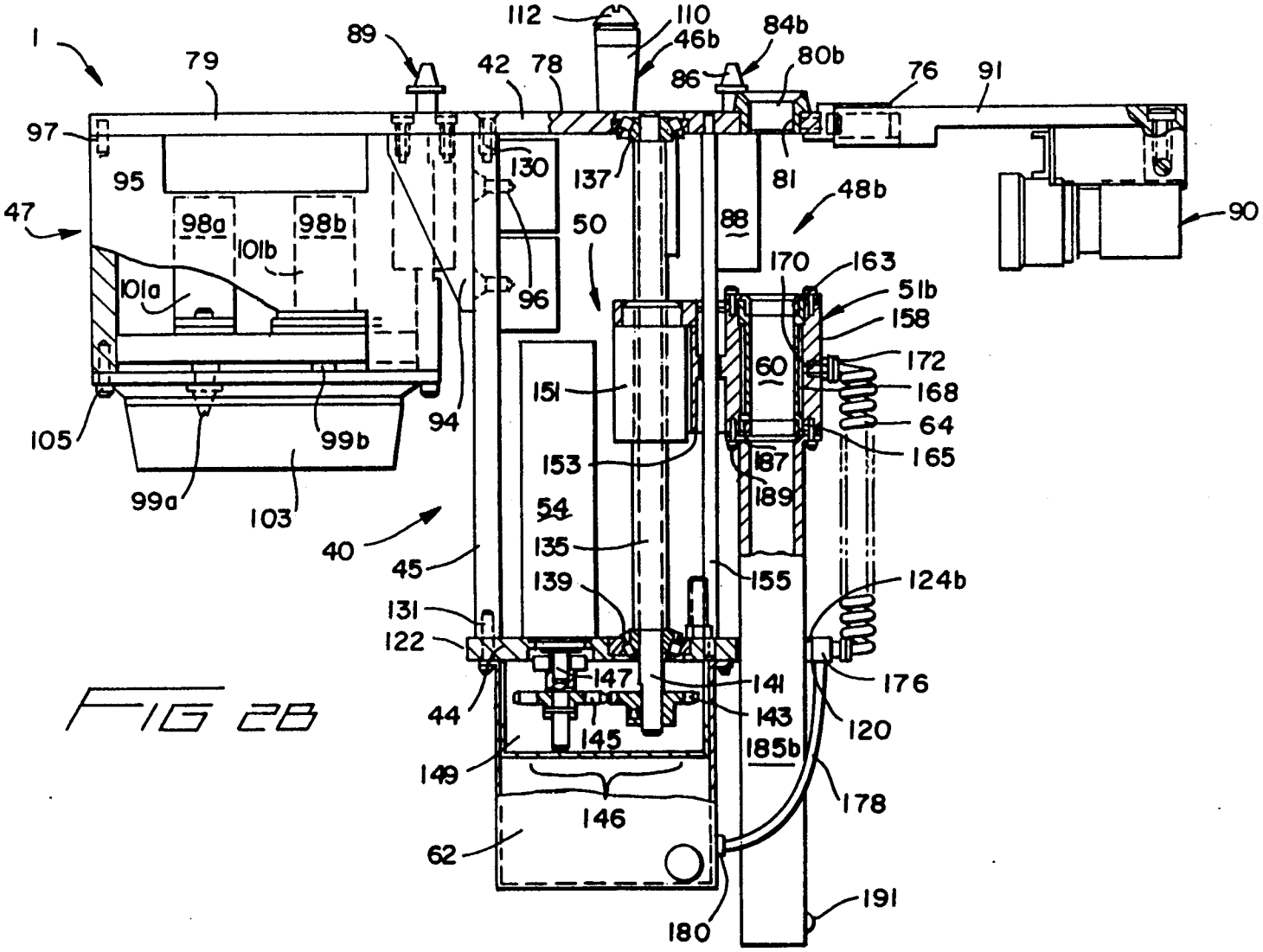
FIG. 2B is a partial cross-sectional side view of the multiple probe oscillating apparatus illustrated in FIG. 2A.
Figure 2C:
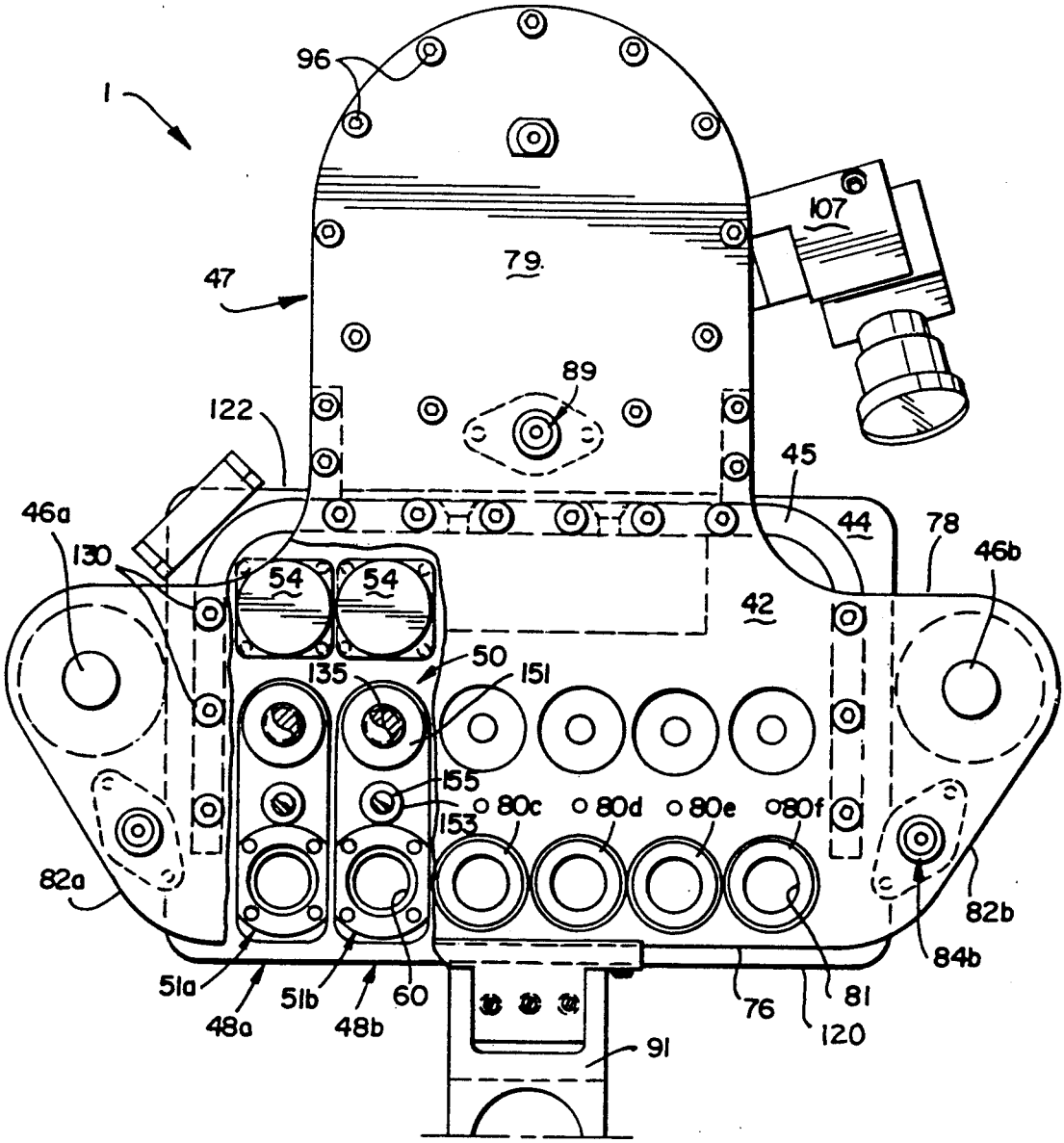
FIG. 2C is a top plan view of the apparatus illustrated in FIG. 2A.

With reference now to FIGS. 2A–2D, the top plate 42 of the frame 40 includes a distal edge 76, a proximal edge 78, and a coupler plate portion 79. Six uniformly-spaced bushings 80a–80f are positioned along the distal edge 76 of the top plate 42 as shown. Each of these bushings 80a–80f is preferably formed from a self-lubricating plastic material, which may be nylon, and includes a centrally disposed guide port 81 for conducting and guiding one of the heater probes 3a–3f. The spacing between the bushings 80a–80f corresponds to the spacing between the open ends of the heat exchange tubes 5. Thus, when the top plate 42 is properly positioned, each of the bushings 80a–80f is aligned with the open end of a heat exchanger tube 5. Disposed on opposite sides of the top plate 42 are tapered side portions 82a,82b. The tapered shape of these side portions 82a,82b allows the bushings 80a–80f to be aligned with peripherally-located heat exchanger tubes without mechanical interference, thereby obviating the need for using different tools for servicing heat exchanger tubes 5 located in the central and peripheral portions of the tubesheet 7. As is best seen in FIGS. 2A and 2C, a pair of level sensors 84a,84b are provided on the tapered portions 82a,82b of the top plate 42. Each of the level sensors 84a,84b includes a spring-loaded finger 86 which is received within the body 88 of linear potentiometer. Another level sensor 89 of identical structure is located on the coupler plate portion 79 of the top plate 42. The purpose of these leveling sensors 84a,84b and 89 is to confirm to the system operator that the top plate 42 is parallel with respect to the tubesheet 7 before the cam-locks 46a,46b are actuated to attach the apparatus 1 to the tubesheet 7.

On the distal end of the top plate 42, a television camera assembly 90 is mounted by way of a removable bracket 91. This camera assembly 90 allows the system operator to observe the insertion of the heater probes 3a–3f through the bushings 80a–80f of the top plate 42. The camera assembly 90 and bracket 91 are removed when the apparatus 1 is used to service peripherally located tubes 5. On the proximal end of the top plate 42, the previously mentioned robotic arm coupler 49 is mounted onto the coupler plate portion 79. As is best seen with respect to FIG. 2B, the coupler 49 includes a pair of mounting flanges 94 (of which only one is shown) for securing the coupler housing 95 onto the side plate 45 by means of mounting screws 96. The housing 95 is further mounted onto the plate portion 79 by upper mounting screws 97. Disposed within the housing 95 are a pair of robotic arm sensors 98a,98b for sensing the presence of the robotic arm 19. Like the previously described level sensors 84a,84b each of the robotic arm sensors 98a,98b includes a spring-loaded finger 99 which is reciprocably movable within the body 101 of a linear potentiometer. Located at the bottom of the housing 95 is a coupling sleeve 103 designed to receive a complementary coupling (not shown) present at the distal end of the robotic arm 19. The sleeve 103 is secured around the bottom edge of the housing 95 by screws 105. As is best seen in FIG. 2C, another television camera assembly 107 is attached onto the housing 95 of the coupler 49. This television assembly 107 allows the system operator to remotely monitor the positioning of the cam-lock 46b into the open end of a heat exchanger 5 mounted in the tubesheet 7.

As is best seen with respect to FIGS. 2A and 2B, each of the cam-locks 46a,46b includes an expandable collet 110 that is insertable with the open end of one of the heat exchanger tubes 5 mounted in the tubesheet 7. A cork-shaped expander element 112 is reciprocably movable within the expandable collet 110 and is connected to the piston rod of a pneumatic cylinder 114. The cylinder 114 causes the collet 110 to expand into engagement with the inner wall of a heat exchanger tube 5 when it pulls the expander element 112 downwardly into the cylinder body. The pneumatic cylinder 114 is powered by a gas line 116, which in turn is pneumatically coupled to a source of pressurized gas.

Figure 2D:
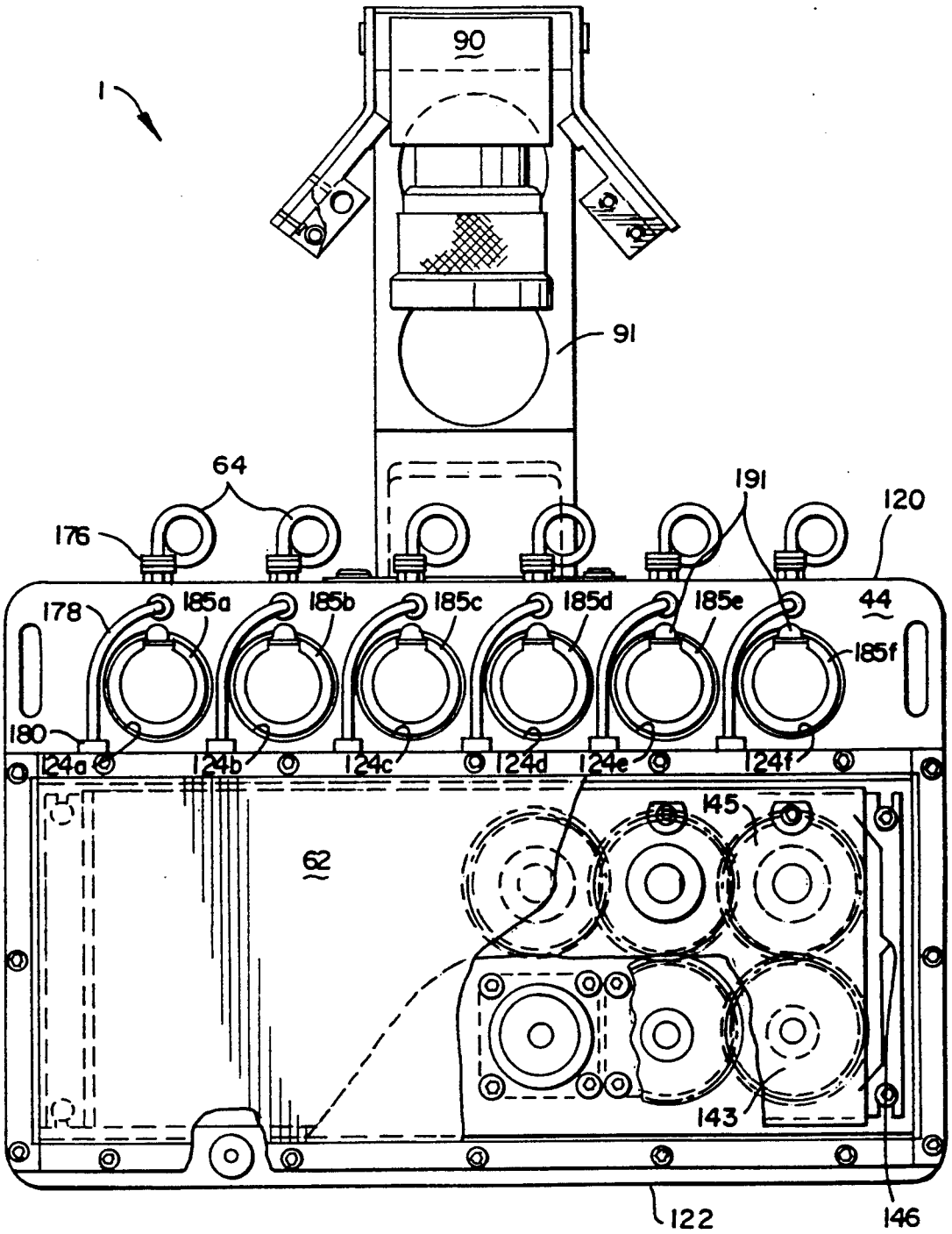
FIG. 2D is a bottom plan view of the apparatus illustrated in FIG. 2A.

With reference now to FIG. 2D, the bottom plate 44 of the frame 40 is generally rectangular in shape, having a distal edge 120, and a proximal edge 122. Located the distal edge 120 are a series of guide tube bores 124a–124f. As will be discussed presently, the purpose of these bores 124a–124f is to receive and guide the guide tubes 185a–185f which are in turn connected to the undersides of the grippers 51a–51f. Connected between the top and bottom plates 42, 44 is the previously mentioned side plate 45. Upper and lower mounting screws 130, 131 secure the top plate 42 and bottom plate 44 around the upper and lower edges of the side plate 45, respectively. To reduce the overall weight of the frame 40, the top, bottom and side plates 42, 44 and 45 are each formed from an aluminum alloy. Additionally, to avoid mechanical interference between the bowl-shaped wall of the primary side 1 and the apparatus 1, the distance between the top and bottom plates 42, 44 is chosen so that it is long enough to accommodate the stroke of the oscillating mechanism 50, but short enough so as not to create any mechanical interference between the frame 40 and the bowl shaped wall of the primary side 11 which is adjacent to the periphery of the tubesheet 7.

With specific reference again to FIG. 2B, each of the oscillating mechanisms 50 includes a threaded rod 135 which is rotatably connected at its ends to the top and bottom plates 42, 44 by means of an upper bearing 137 and a lower bearing 139. The lower end 141 of the threaded rod 135 includes a gear 143 which is driven by a gear 145 connected to the shaft 147 of the reversible, d.c. motor 54. Together, the two gears 143 and 145 form a drive train 146 which transmits, at a reduced speed, the output of the shaft 147 of the motor 54 to the threaded rod 135. The drive train 56 of the oscillating mechanism 50 of each of the probe drivers 48*a*–48*f* is contained within a housing 149 to protect it from dust and moisture. The oscillating mechanism 50 of each of the probe drivers 48*a*–48*f* further includes a ball nut 151 that is engaged to the rod 135 through a threaded bore in its interior and which is further connected on its exterior to one of the grippers 51*a*–51*f* through a linear bearing 153. The linear bearing 153 is in turn engaged upon a guide rod 155. The purpose of the bearing 153 and rod 155 is, of course, to convert the oscillatory movement generated by the interaction between the ball nut 151 and the threaded rod 135 to an oscillatory movement of one of the grippers 58*a*–58*f*. Threaded rod 135 of each of the oscillator mechanisms 50 is between two and three times as long as the length of the stroke of the grippers 51*a*–51*f* during the operation of the apparatus. Such dimensioning provides the system operator with a broad degree of freedom in precisely aligning the midpoint 35 of the bulb filament 24 with the midline 37 of the support plate 12 prior to the oscillation of the heater probes 3*a*–3*f*.

Each of the previously mentioned grippers 51*a*–51*f* includes a gripper body 159 having a centrally disposed bore which houses the previously mentioned elastomeric sleeve 60. The sleeve 60 in turn includes upper and lower annular flanges 163, 165 which are sealingly engaged within annular recesses which circumscribe the upper and lower edges of the bore within the gripper body 159. An annular, gas conducting space 168 is present between the outer wall of the sleeve 60 and the inner surface of the bore in the gripper body 159. This annular space 168 ultimately communicates with pressurized gas distributed from the previously mentioned manifold 62 by way of a gas bore 170 that is connected to a fitting 172 screwed into the cylindrical gripper body 159. The previously mentioned coiled gas tube 64 connects the fitting 172 into a lower fitting 176 screwed into the distal end of the bottom plate 44. A short connecting tube 178 pneumatically connects the lower gas fitting 176 with a manifold gas fitting 180 which may easily be seen in FIGS. 2A, 2B and 2D.

As has been indicated previously, a guide tube 185*a*–185*f* is mounted around the bottom ends of the cylindrical body 159 of each of the grippers 51*a*–51*f*. To this end, the upper end of each of the guide tubes includes an annular flange 187 that is secured around the bottom edge of the cylindrical body 158 of the grippers 51*a*–51*f* by means of mounting screws 189. As is best seen in FIGS. 2A and 2B, the bottom end of each of tubes 185*a*–185*f* includes a spring-loaded detent 191. The purpose of the detent 191 is to secure a guide sleeve (not shown) which is detachably connected around the bottom end of each of the tubes 185*a*–185*f* for assisting the system operator in pushing the push-cables 27 of each of the heater probes 3*a*–3*f* through the grippers 51*a*–51*f*, the bushings 80*a*–80*f* and the tubes 5 until the incandescent bulb 23 of each of the heater probes 3*a*–3*f* is generally positioned in the region of the tube 5 surrounded by a support plate 12. Each of the guide tubes 185*a*–185*f* is slidably engaged to a bore 124*a*–124*f* located in the bottom plate 44 of the frame 40. The sliding connection between the tubes 185*a*–185*f* and the bores with the bottom plate 44 assists the guide rod 155 in performing its function of transferring the oscillatory movement of the ball nut 151 to a reciprocation of one of the grippers 51*a*–51*f*.

We claim:

1. A process for remotely heat treating selected portions of a plurality of tubes having open ends that are mounted in a tubesheet with a plurality of heater probes, wherein each heater probe includes a radiant heater element connected to a variable power source, and one probe includes a temperature sensor spaced apart from its respective heater element, and wherein said process is implemented by a first tool capable of positioning and oscillating sai heater probe having a temperature sensor within selected tubes and of momentarily positioning the temperature sensor adjacent to the portion of the tube heated by the radiant heater element to measure the temperature thereof, and a second tool capable of positioning and oscillating a plurality of heater probes within a plurality of tubes, comprising the steps of a. determining the amount of power that said variable power source must conduct through each heater probe for them to heat a selected temperature range by using said first tool to position and oscillate said temperature sensing heater probe within a portion of a selected tube and to periodically monitor the resulting temperature of the heated tube portion by momentarily positioning the temperature sensor adjacent to the heated tube portion;

b. detachably connecting the second tool to the tubesheet, and c. positioning and oscillating a plurality of heater probes in a plurality of tubes with said second tool in order to simultaneously heat selected portions of said tubes to within said selected temperature range.

2. The process defined in claim 1, wherein step a. is performed on a plurality of randomly selected tubes to more accurately determine the amount of power level associated with said selected temperature range.

3. The process defined in claim 1, wherein said second tool includes means for fine positioning said heater probes, and further including the step of using said second tool to precisely align said heater probes at the midpoint of each of the selected tube sections prior to oscillating said probes within said tube sections.

* * * * *